US007984834B2

(12) United States Patent
McBroom et al.

(10) Patent No.: US 7,984,834 B2
(45) Date of Patent: Jul. 26, 2011

(54) AEROSOL DISPENSER VALVE

(75) Inventors: James P. McBroom, House Springs, MO (US); Joseph C. Lott, Des Peres, MO (US); Clyde E. Smothers, Fenton, MO (US)

(73) Assignee: Clayton Corporation, Fenton, MO (US)

( * ) Notice: Subject to any disclaimer, the term of this patent is extended or adjusted under 35 U.S.C. 154(b) by 1200 days.

(21) Appl. No.: 11/228,000

(22) Filed: Sep. 15, 2005

(65) Prior Publication Data

US 2006/0065678 A1 Mar. 30, 2006

Related U.S. Application Data

(60) Provisional application No. 60/627,850, filed on Nov. 15, 2004, provisional application No. 60/610,282, filed on Sep. 16, 2004.

(51) Int. Cl.
*B65D 83/16* (2006.01)

(52) U.S. Cl. ..... 222/402.1

(58) Field of Classification Search ..... 222/401.1, 222/402.1

See application file for complete search history.

(56) References Cited

U.S. PATENT DOCUMENTS

| | | | | |
|---|---|---|---|---|
| 3,954,208 | A | 5/1976 | Brill | 222/402.23 |
| 4,216,884 | A | 8/1980 | Giuffredi | 222/402.16 |
| 4,429,814 | A * | 2/1984 | Scotti et al. | 222/402.13 |
| 4,437,592 | A | 3/1984 | Bon | 222/402.12 |
| 4,852,807 | A | 8/1989 | Stoody | 239/337 |
| 5,456,386 | A | 10/1995 | Jesswein | 222/136 |
| 5,553,755 | A | 9/1996 | Bonewald et al. | 222/402.21 |
| 5,836,299 | A | 11/1998 | Kwon | 128/200.23 |
| 5,865,351 | A * | 2/1999 | De Laforcade | 222/402.1 |
| 5,894,958 | A * | 4/1999 | De Laforcade | 222/136 |
| 5,921,447 | A | 7/1999 | Barger et al. | 222/402.2 |
| 5,975,356 | A | 11/1999 | Yquel et al. | 222/54 |
| 5,988,699 | A * | 11/1999 | Quandt | 285/142.1 |
| 6,113,070 | A | 9/2000 | Holzboog | 251/342 |
| 6,202,899 | B1 | 3/2001 | Lasserre et al. | 222/402.1 |
| 6,245,415 | B1 * | 6/2001 | Keller et al. | 428/188 |
| 6,291,580 | B1 * | 9/2001 | Kukkala et al. | 524/840 |
| 6,750,265 | B2 * | 6/2004 | Pauls et al. | 521/107 |
| 7,226,553 | B2 * | 6/2007 | Jackson et al. | 264/142 |
| 2004/0025852 | A1 * | 2/2004 | Kanekawa et al. | 123/549 |
| 2004/0104373 | A1 * | 6/2004 | Dutmer et al. | 251/305 |
| 2004/0260046 | A1 * | 12/2004 | Smith et al. | 526/352 |
| 2005/0011883 | A1 * | 1/2005 | Clothier et al. | 219/618 |

OTHER PUBLICATIONS

International Preliminary Report on Patentability (PCT/US2005/33701).

* cited by examiner

*Primary Examiner* — J Jacyna

(74) *Attorney, Agent, or Firm* — Harness, Dickey & Pierce, P.L.C.

(57) ABSTRACT

An improved valve member, aerosol dispenser valve containing the valve member, aerosol container for dispensing moisture curable foams, and moisture curable foam and dispenser, in which the valve member is made of a glass filled polyolefin. The polyolefin is preferably a polyethylene. The glass content is between about 2% and about 40%, more preferably between about 10% and about 30%; and most preferably between about 15% and about 25%.

18 Claims, 1 Drawing Sheet

AEROSOL DISPENSER VALVE

CROSS-REFERENCE TO RELATED APPLICATIONS

This application claims the benefit of U.S. Provisional Application No. 60/627,850, filed Nov. 15, 2004, and U.S. Provisional Application No. 60/610,282, filed Sep. 16, 2004, the entire disclosures of which are incorporated herein by reference.

BACKGROUND OF THE INVENTION

This invention relates to aerosol dispenser valves for products, and in particular to dispenser valves for moisture curable products such as foams.

Moisture curable products, such as moisture curable polyurethane foams, have found wide application in homes and businesses. These foams are excellent fillers and insulators. The foams are often packaged in aerosol cans with a polypropylene dispenser valve. A problem with these valves is that moisture can migrate through the valve and into the aerosol can. Once inside, the moisture cures the foam, and impairs the function of the valve. The problem is exacerbated if the can is not stored upright, so that the contents of the can surround the valve member. The migration path is shorter, and when the foam cures around the valve member it interferes with the operation of the valve, sealing it closed.

SUMMARY OF THE INVENTION

A preferred embodiment of the present invention is a dispenser valve for a moisture-curable foam made from a glass-filled polyolefin. In the preferred embodiment the polyolefin is a high density polyethylene. The polyethylene preferably has a glass content of between about 2% and about 40%, and more preferably between about 10% and about 30%, and most preferably between about 15% and about 25%. The valve member of the preferred embodiment is more resistant to failure from moisture infiltration than the polypropylene valve members of the prior art. The valve member of the preferred embodiment is less adhesive than the propylene valve members of the prior art, so that to the extent that the contents of the container does inadvertently cure inside the container, it is less likely to adhere to the valve member and interfere with the operation of the valve. Thus embodiments of valves in accordance with the principles of this invention can extend the shelf life of urethane foams and other moisture curable or moisture affected products dispensed from aerosol cans.

DETAILED DESCRIPTION OF THE PREFERRED EMBODIMENTS

Figure 1:
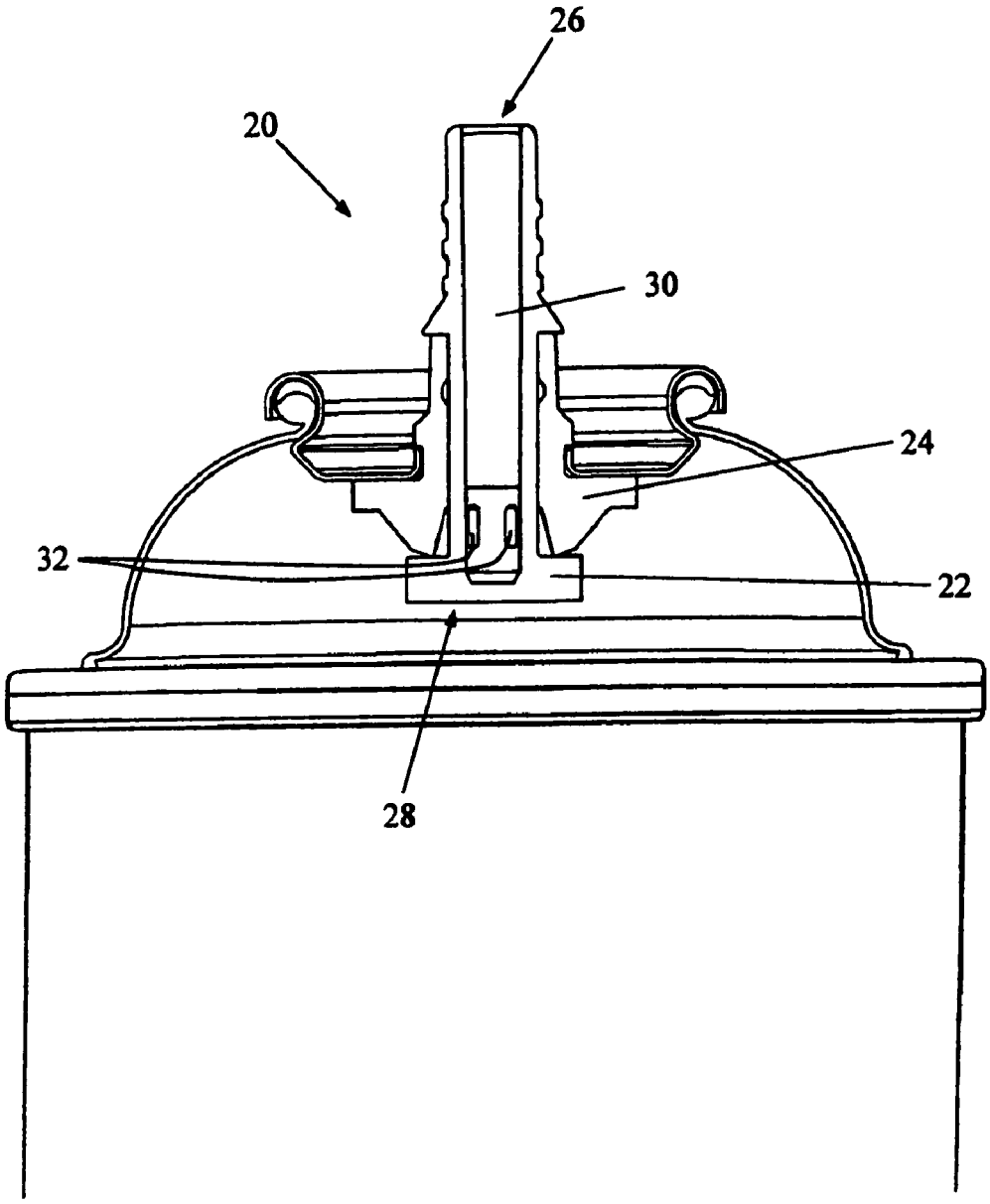
FIG. 1 is a cross sectional view of a dispenser valve for an aerosol can in accordance with the principles of this invention.

A preferred embodiment of dispenser valve constructed according to the principles of this invention is indicated generally as 20 in FIG. 1. The dispenser valve 20 comprises a valve member 22 in a seal 24. The valve member 22 has first and second ends 26 and 28, and a central passage 30 extending partially therethrough. A plurality of openings 32 extend through the valve member 22 and communicate with the central passage 30. The openings are covered by the seal 24, but when the valve member 22 is deflected, it opens a space between the valve member 22 and the seal 24, so that the pressurized contents can exit the container between the valve member 22 and the seal, through the openings 32, and out the passage 30.

In accordance with the principles of this invention, the valve member 22 is made from a glass-filled polyolefin. The inventors believe that glass-filled polyethylene is more resistant to adhesion than the polypropylene valve members of the prior art, or other suitable polymer materials.

The inventors have also discovered that chemically coupled glass-filled polyolefin, and specific glass-filled polyethylene is less adhesive than the valve members of the prior art, to the extent that the foam does inadvertently cure inside the container, it is less likely to adhere to the valve member and interfere with the operation of the valve.

The polyethylene is preferably a high density polyethylene. The polyethylene preferably has a glass content of between about 2% and about 40%, and more preferably between about 10% and about 30%, and most preferably between about 20% and about 30%.

Thus the valve member of the preferred embodiment are more resistant to moisture infiltration, and less adhesive to moisture curing foams, such as polyurethanes. Thus the valves constructed in accordance with the valve members of this invention are less likely fail, even when the cans on which they are used are not properly stored, and provide a greater product shelf life.

Example 1

Cans of moisture curable polyurethane foam components were prepared with valve parts made of different plastics. The cans were stored upside down at ambient temperature and 90-100% relative humidity. Each week three cans of each type were examined and rated on whether the can was fully functional, stuck but functional, or stuck. Failure was determined when all three cans of the sample failed. The results of the test are given in Table 1.

TABLE 1

| 20% glass-filled polyethylene | Impact modified propylene | Poly-propylene | Acetal | Internally Lubricated polypropylene |
|---|---|---|---|---|
| No failure after 16 weeks. | Failure after 5 weeks. | Failure after 5 weeks. | Sticking after 7 weeks; failure after 9 weeks | Sticking after 5 weeks; failure after 6 weeks |

Example 2

Cans of moisture curable polyurethane foam components were prepared with valve parts made from different plastics. Sixteen cans of each type were stored upside down at 120° at 80% relative humidity for 11 weeks. Cans were inspected at the end of 11 weeks to determine whether the valves were stuck or were functional. The results are given were given in Table 2.

TABLE 2

| Plastic | Number of stuck valves | % of stuck valves |
|---|---|---|
| 50% polyethylene and 50% polyethylene with 20% glass | 0 | 0% |
| 100% polyethylene with 20% glass | 2 | 12.5% |
| 90% polyethylene - 10% polypropylene with 30% glass | 3 | 18.8% |
| 75% polyethylene - 25% polypropylene with 30% glass | 3 | 18.8% |
| 100% polypropylene | 4 | 25% |
| 50% polyethylene - 50% polypropylene | 5 | 31.3% |
| 50% polyethylene - 50% polypropylene with 30% glass | 5 | 31.3% |
| 100% polyethylene | 6 | 37.5% |
| 90% polyethylene - 10% polypropylene | 6 | 37.5% |
| 75% polyethylene - 25% polypropylene | 10 | 62.5% |

This test shows that valves made of glass filled polyethylene (from 10% to 20%) had the lowest number of stuck valves.

Example 3

Cans of moisture curable polyurethane foam components were prepared with large valve parts made from different plastics. Twenty-two cans of each type were stored upside down at ambient with caps filled with water. Two cans of each type were tested periodically, and it was noted whether the valve worked, whether the valve was stuck but broke free, or whether the valve failed. The results are given in Table 3.

TABLE 3

| 20% glass-filled polyethylene | Polypropylene | Acetal |
|---|---|---|
| No failure after 22 weeks. | Stuck but broke free, after 18 weeks. | Stuck but broke free, after 13 weeks-failure after 22 weeks |

Example 4

Cans of moisture curable polyurethane foam components were prepared with small valve parts made from different plastics. Twenty-two cans of each type were stored upside down at ambient with caps filled with water. Two cans of each type were tested periodically, to determine whether the valve worked, whether the valve was stuck but broke free, or whether the valve failed. The results are given in Table 4.

TABLE 4

| 20% glass-filled polyethylene | Impact Modified Polypropylene | Acetal | Ethylene Telefluorethylene polymer (ETFE) |
|---|---|---|---|
| No sticking or failure after 22 weeks. | Failed, after 8 weeks. | Stuck but broke free, after 12 weeks; failure, after 17 weeks. | Failures after 19 weeks |

Example 5

Cans of moisture curable polyurethane foam components were prepared with valve parts made from different plastics. Cans of each type were stored upside down with caps filled with water at 130° F. (to accelerate sticking of the valves). Two cans of each type were periodically tested to determine whether the valve worked, whether the valve was stuck but broke free, or whether the valve failed. The results are given were given in Table 5.

TABLE 5

| 20% glass-filled polyethylene | Polypropylene | Acetal |
|---|---|---|
| No sticking or failure after 51 days. | Stuck but broke free after 14 days, failure after 35 days. | Stuck but broke free after 14 days; failure after 37 days. |

Example 6

Cans of moisture curable polyurethane foam components were prepared with valve parts made from different plastics. Cans of each type were stored upside down with caps filled with water at 130° F. (to accelerate sticking of the valves). 20% glass filled polyethylene was compared with impact modified propylene for two different neoprene seal materials. Two cans of each type were periodically tested to determine whether the valve worked, whether the valve was stuck but broke free, or whether the valve failed. Failure was determined when both valves tested stuck or failed. The results are given were given in Table 6.

TABLE 6

| Seal 1 | | Seal 2 | |
|---|---|---|---|
| 20% glass-filled polyethylene | Impact Modified polypropylene | 20% glass-filled polyethylene | Impact Modified polypropylene |
| No sticking or failure after 23 days. | Failure after 11 days. | Failure, after 21 days. | Failure after 11 days. |

This testing indicates that glass-filled polyethylene provides improved performance with different seal materials.

Example 7

Cans of moisture curable polyurethane foam components were prepared with valve parts made from different plastics. Cans of each type were stored upside down with caps filled with water at 130° F. (to accelerate sticking of the valves). 20% glass filled polyethylene was compared with propylene and with a conventional valve using a stick resistant coating on the seal. Two cans of each type were periodically tested to determine whether the valve worked, whether the valve was stuck but broke free, or whether the valve failed. The results are given were given in Table 7.

TABLE 7

| 20% glass-filled polyethylene | Polypropylene | Polypropylene with stick resistant seal coating |
|---|---|---|
| Stuck but broke free after 30 days; no failure at 36 days | Stuck but broke free after 22 days; failure after 28 days | Stuck but broke free after 22 days; failure after 30 days |

This testing indicates that glass-filled polyethylene continued to function after conventional valves and conventional valves with lubricated seals, failed.

Example 8

Cans of moisture curable polyurethane foam components were prepared with gun valve (vertically opened) parts made from different plastics. Sixteen cans of each type were stored upside down at 130° with caps full of water. Two cans of each type were tested periodically, and its was noted whether the valve worked, whether the valve was stuck but broke free, or whether the valve failed. Failure was determined by sticking or failure of both cans. The results are given were given in Table 8.

TABLE 8

| Plastic | First Sticking | First Failure |
|---|---|---|
| 100% polyethylene with 20% glass-filled polyethylene (ribbed for extra strength) | — | — |
| Impact Modified Polypropylene co-polymer (ribbed for extra strength) | 10 days | — |
| Polypropylene | 13 days | 55 days |
| Acetal | 10 days | 33 days |
| Impact Modified Polypropylene | 13 days | 33 days |
| Polyethylene | — | 26 days* |
| 75% polyethylene - 25% polypropylene | 10 days | |
| 50% polyethylene - 50% polypropylene | 10 days | |
| 100% polyethylene with 20% glass-filled polyethylene | — | — |
| Impact Modified Polypropylene | 10 days | |

*stem failure due to weakness of material

This testing shows the superiority of glass filled polyethylene in both ribbed and unribbed configurations.

Example 9

Cans of moisture curable polyurethane foam components were prepared with gun valve (vertically opened) parts made from different plastics. Twelve to Fourteen cans of each type were stored upside down at 130° with caps full of water. Cans of each type were tested periodically, and its was noted whether the valve worked, whether the valve was stuck but broke free, or whether the valve failed. Failure was determined by sticking or failure of both cans. The results are given were given in Table 9 below, which shows that some standard valves first stuck after only six days and the standard valves were stuck after 11 days, as compared to the valves with 20% glass-filled Polyethylene valve components which were not stuck after 20 days of testing. All of the 20% glass-filled Polyethylene valve components performed longer than the standard components. The plastic used is a 703 CC chemically coupled 20% glass filled polyethylene available from RTP company, having an impact strength (notched) of about 2.5 ft. lbs./inch and a water absorption of about 0.04 percent.

TABLE 9

| Plastic | First Stuck | Valves stuck |
|---|---|---|
| 100% Polyethylene with 20% glass-filled stems | none of 14 samples stuck | no samples stuck after 20 days |
| Impact Modified Polypropylene co-polymer (ribbed for extra strength) | samples first stuck w/in 6 days | 12 samples stuck w/in 11 days |

In the testing conducted, a glass filled polyethylene was always the best performer, and only one other material—acetal—approached the performance of the glass-filled polyethylene in certain circumstances. Glass-filled polyethylene valve stems show surprisingly superior resistance to sticking (i.e. longer times to initial sticking, and longer times to valve failure) over valve stems of other materials in a variety environments, different valve sizes, and different sealing materials. Glass-filled polyethylene even showed superior resistance to sticking than conventional valves with available stick resistance coatings.

While the description of the preferred embodiment and the examples and tests focused primarily on moisture curable foams, and more specifically moisture curable polyurethane foams, the invention is not so limited and the valves and containers with valves of the present invention can be used with other moisture curable products that are dispensed from aerosol cans, and even with products that are not moisture curable, but adversely affected by moisture infiltration.

What is claimed is:

1. An improved valve for dispensing a moisture curable foam substance, the improvement comprising:

a moisture curable foam disposed within a container; and a valve member in communication with the moisture curable foam, being made of a glass filled polyolefin and having a glass content in an amount sufficient to resist failure of the valve in a closed position caused by sticking due to inadvertent curing of the moisture curable foam substance in the container that may interfere with operation of the valve member.

2. The improved valve according to claim 1 wherein the polyolefin is a polyethylene.

3. The improved valve according to claim 1 wherein the glass content is between about 3% and about 30%.

4. The improved valve member according to claim 3 wherein the glass content is between about 8% and about 25%.

5. The improved valve according to claim 3 wherein the glass content is between about 10% and about 20%.

6. An improved valve for dispensing a moisture curable polyurethane foam substance from a pressurized container, the valve comprising a valve member and a seal, the improvement comprising:

a moisture curable foam disposed within a pressurized container; and a valve member in communication with the moisture curable foam, being made of a glass filled polyolefin, having a glass content of an amount that is effective to resist failure of the valve in a closed position caused by inadvertent curing of the moisture curable foam substance around the valve member and seal that may interfere with operation of the valve member.

7. The improved valve according to claim 6 wherein the polyolefin is a polyethylene.

8. The improved valve according to claim 6 wherein the glass content is between about 3% and about 30%.

9. The improved valve according to claim 8 wherein the glass content is between about 8% and about 25%.

10. The improved valve according to claim 9 wherein the glass content is between about 10% and about 20%.

11. An improved aerosol dispenser for moisture curable foam, the dispenser comprising a can with an aerosol valve comprising a valve member and a seal for dispensing the moisture curable foam under pressure from the can, the improvement comprising:

a moisture curable foam disposed within the pressurized can; and a valve member in communication with a moisture curable polyurethane foam disposed within the can, the valve member being made of a chemically-coupled glass filled polyolefin, having a sufficient amount of glass content of between about 3% and about 25%, such that to the extent that the moisture curable polyurethane foam does inadvertently cure inside the container it is less likely to cause the valve member to fail in a closed position against the seal and interfere with operation of the valve member.

12. The improved dispenser according to claim 11 wherein the polyolefin is a polyethylene.

13. The improved dispenser according to claim 11 wherein the glass content is between about 10% to about 20% by weight.

14. An improved moisture curable foam and dispenser, the dispenser comprising a can with an aerosol valve comprising a valve member and a seal for dispensing the moisture curable foam under pressure from the can; and the moisture curable foam comprising at least two liquid components under pressure in the can, which cure when exposed to moisture, the improvement comprising:

a moisture curable foam disposed within the pressurized can; and a valve member in communication with the moisture curable foam disposed within the can, the valve member, being made of a chemically-coupled glass filled polyolefin, and having a glass content of between about 3% and about 25%, such that to the extent that the moisture curable polyurethane foam does inadvertently cure inside the container it is less likely to cause the valve member to fail in a closed position against the seal and interfere with operation of the valve member.

15. The improved moisture curable foam and dispenser according to claim 14 wherein the polyolefin is a polyethylene.

16. The improved moisture curable foam and dispenser according to claim 14 wherein the glass content is between about 10% and about 20% by weight.

17. The improved valve of claim 3, further comprising a neoprene seal against which the polyolefin valve closes, wherein the polyolefin valve includes a sufficient amount of glass fill of at least about 3% to resist sticking of the valve in a closed position against the neoprene seal that may be caused by inadvertent curing of the moisture curable foam substance.

18. The improved valve of claim 9, further comprising a neoprene seal against which the polyolefin valve closes, wherein the polyolefin valve includes a sufficient amount of glass fill of at least about 8% to resist sticking of the valve in a closed position against the neoprene seal that may be caused by inadvertent curing of the moisture curable polyurethane foam substance.

* * * * *

UNITED STATES PATENT AND TRADEMARK OFFICE

CERTIFICATE OF CORRECTION

PATENT NO. : 7,984,834 B2
APPLICATION NO. : 11/228000
DATED : July 26, 2011
INVENTOR(S) : James P. McBroom, Joseph C. Lott and Clyde E. Smothers It is certified that error appears in the above-identified patent and that said Letters Patent is hereby corrected as shown below:

In the claims:

At column 7, in claim 11, line 29, replace “container” with “can”.

At column 7, in claim 12, line 33, replace “improved dispenser” with “improved aerosol dispenser”.

At column 7, in claim 13, line 35, replace “improved dispenser” with “improved aerosol dispenser”.

At column 8, in claim 14, line 1, replace “curable foam and dispenser” with “curable foam dispenser”.

At column 8, in claim 14, line 16, replace “container” with “can”.

At column 8, in claim 15, line 19, replace “curable foam and dispenser” with “curable foam dispenser”.

At column 8, in claim 16, line 22, replace “curable foam and dispenser” with “curable foam dispenser”.

Signed and Sealed this
Eighteenth Day of October, 2011

David J. Kappos

David J. Kappos
*Director of the United States Patent and Trademark Office*